US012644225B2

(12) United States Patent
Tseng et al.

(10) Patent No.: US 12,644,225 B2
(45) Date of Patent: Jun. 2, 2026

(54) SYNTHETIC LEATHER

(71) Applicant: DIC Corporation, Tokyo (JP)

(72) Inventors: Ya-Yi Tseng, Takaishi (JP); Ryo Maeda, Takaishi (JP)

(73) Assignee: DIC Corporation, Tokyo (JP)

( * ) Notice: Subject to any disclaimer, the term of this patent is extended or adjusted under 35 U.S.C. 154(b) by 342 days.

(21) Appl. No.: 18/278,720

(22) PCT Filed: Sep. 9, 2021

(86) PCT No.: PCT/JP2021/033081
§ 371 (c)(1),
(2) Date: Aug. 24, 2023

(87) PCT Pub. No.: WO2022/180897
PCT Pub. Date: Sep. 1, 2022

(65) Prior Publication Data

US 2024/0309582 A1 Sep. 19, 2024

(30) Foreign Application Priority Data

Feb. 25, 2021 (JP) ..... 2021-028405

(51) Int. Cl.
*D06N 3/14* (2006.01)

(52) U.S. Cl.
CPC ..... *D06N 3/146* (2013.01); *D06N 3/145* (2013.01); *D06N 2203/068* (2013.01); *D06N 2211/28* (2013.01); *D06N 2213/03* (2013.01); *Y10T 428/24438* (2015.01)

(58) Field of Classification Search
CPC .. D06N 3/146; D06N 3/145; D06N 2203/068; D06N 2211/28; D06N 2213/03; Y10T 428/24438
See application file for complete search history.

(56) References Cited

U.S. PATENT DOCUMENTS

| | | | | |
|---|---|---|---|---|
| 11,505,896 | B2 | 11/2022 | Maeda | |
| 2008/0214709 | A1 | 9/2008 | Licht et al. | |
| 2013/0109804 | A1 | 5/2013 | Kusaka et al. | |
| 2014/0212676 | A1 * | 7/2014 | Tetsui | C08G 18/758 156/289 |
| 2019/0375935 | A1 | 12/2019 | Shikuri et al. | |
| 2022/0025104 | A1 * | 1/2022 | Tseng | C08G 18/758 |

FOREIGN PATENT DOCUMENTS

| | | | | |
|---|---|---|---|---|
| CN | 107075336 | A | 8/2017 | |
| CN | 111201347 | A | 5/2020 | |
| EP | 2284215 | A2 * | 2/2011 | G03G 9/08775 |
| EP | 3398980 | A1 | 11/2018 | |
| EP | 3459987 | A1 | 3/2019 | |
| EP | 3591116 | A1 | 1/2020 | |
| JP | 2016-027114 | A | 2/2016 | |
| JP | 2016-222921 | A | 12/2016 | |
| JP | 2017-133024 | A | 8/2017 | |
| JP | 2020023761 | A * | 2/2020 | |
| KR | 101810267 | B1 | 12/2017 | |
| WO | 2019/082475 | A1 | 5/2019 | |

OTHER PUBLICATIONS

[NPL-1] Fukuie et al. (JP 2020-023761 A); Feb. 13, 2020 (European Patent Office machine translation to English). (Year: 2020).*

* cited by examiner

*Primary Examiner* — Donald M Flores, Jr.
(74) *Attorney, Agent, or Firm* — Troutman Pepper Locke LLP; James E. Armstrong, IV

(57) ABSTRACT

The present invention provides a synthetic leather including at least a substrate (i), an adhesive layer (ii), and a skin layer (iii), in which the adhesive layer (ii) and the skin layer (iii) are formed from respective specific urethane resin compositions. The adhesive layer (ii) is formed from a urethane resin composition including an anionic urethane resin (X) and water (Y). The skin layer (iii) is formed from a urethane resin composition including an anionic urethane resin (S) and water (T), in which the anionic urethane resin (S) is produced using, for example, a polycarbonate polyol (A-1) produced using biomass-derived decanediol.

9 Claims, No Drawings

SYNTHETIC LEATHER

TECHNICAL FIELD

The present invention relates to a synthetic leather.

BACKGROUND ART

Urethane resin compositions in which a urethane resin is dispersed in water can reduce environmental loads better than conventional organic solvent-based urethane resin compositions, and therefore, have recently started to be suitably used as materials for producing coating agents for synthetic leather (including artificial leather), gloves, curtains, sheets, and the like. Furthermore, in recent years, against the backdrop of global warming and depletion of petroleum resources, global demand for biomass raw materials such as plants has been increasing to reduce the amount of usage of fossil resources such as petroleum.

High durability is required of the urethane resin compositions, in particular, when the urethane resin compositions are used for synthetic leather used as interior materials for vehicles. Evaluation items of such durability are manifold, and examples of the evaluation items include heat resistance, moist heat resistance, light resistance, chemical resistance, and abrasion resistance (for example, see PTL 1). Of these evaluation items, resistance to oleic acid contained in sebum is strongly required of synthetic leather because synthetic leather frequently comes into contact with the human body. However, it has been pointed out that aqueous urethane resin is inferior in oleic acid resistance to solvent-based urethane resin.

Furthermore, in recent years, with uses in cold climate regions in mind, the level of requirement for flexibility at low temperature has been increasing.

CITATION LIST

Patent Literature

PTL 1: Japanese Unexamined Patent Application Publication No. 2016-222921

SUMMARY OF INVENTION

Technical Problem

An object of the present invention is to provide an environmentally friendly synthetic leather produced using a biomass raw material and having high oleic acid resistance, excellent low-temperature flexibility, high peel strength, and high light resistance.

Solution to Problem

The present invention provides a synthetic leather including at least a substrate (i), an adhesive layer (ii), and a skin layer (iii), in which the adhesive layer (ii) is formed from a urethane resin composition including an anionic urethane resin (X) and water (Y); the anionic urethane resin (X) is produced using, as essential raw materials, a polyol (a) including a biomass-derived polycarbonate polyol (a1), a polyisocyanate (b), and an alkanolamine (c); the skin layer (iii) is formed from a urethane resin composition including an anionic urethane resin (S) and water (T); and the anionic urethane resin (S) is produced using, as raw materials, a polycarbonate polyol (A-1) produced using biomass-derived decanediol as a raw material and a polycarbonate polyol (A-2) produced using biomass-derived dihydroxy compound having a cyclic ether structure as a raw material.

Advantageous Effects of Invention

The synthetic leather according to the present invention is an environmentally friendly synthetic leather in which the adhesive layer and the skin layer are both formed from the respective water-containing urethane resin compositions. Furthermore, the adhesive layer and the skin layer are both produced from the respective biomass materials, hence, also in this respect, the synthetic leather is friendly to the environment. Furthermore, the synthetic leather according to the present invention has high oleic acid resistance, excellent low-temperature flexibility, high peel strength, and high light resistance.

DESCRIPTION OF EMBODIMENTS

The synthetic leather according to the present invention includes at least a substrate (i), a specific adhesive layer (ii), and a specific skin layer (iii).

Examples of the substrate (i) that can be used include: fibrous substrates, such as nonwoven fabrics, woven fabrics, and knitted fabrics, each made of polyester fibers, polyethylene fibers, nylon fibers, acrylic fibers, polyurethane fibers, acetate fibers, rayon fibers, polylactic acid fibers, cotton, hemp, silk, wool, glass fibers, carbon fibers, or fiber mixtures thereof; substrates produced by impregnating the nonwoven fabric with resins such as polyurethane resin; substrates produced by adding a porous layer to the nonwoven fabrics; and resin substrates, such as thermoplastic urethane (TPU).

The adhesive layer (ii) is formed from a urethane resin composition including: an anionic urethane resin (X) produced using a specific essential raw material; and water (Y).

To achieve high oleic acid resistance, excellent low-temperature flexibility, and high peel strength, the anionic urethane resin (X) is produced using a polyol (a) including a biomass-derived polycarbonate polyol (a1), a polyisocyanate (b), and an alkanolamine (c), as essential raw materials.

The biomass-derived polycarbonate polyol (a1) is an essential component especially for achieving high oleic acid resistance and excellent low-temperature flexibility.

As the polycarbonate polyol (a1), a reaction product of carbonate and/or phosgene with a glycol compound including biomass-derived glycol can be used. Specific examples of the polycarbonate polyol (a1) that can be used include polycarbonate polyols described in Japanese Unexamined Patent Application Publication No. 2018-127758, Japanese Unexamined Patent Application Publication No. 2017-133024, and Japanese Unexamined Patent Application Publication No. 2011-225863. These polycarbonate polyols may be used alone or in combination of two or more.

From the viewpoint of achieving higher oleic acid resistance and more excellent low-temperature flexibility, among the above-mentioned polycarbonate polyols, a polycarbonate polyol produced using the glycol compound including biomass-derived decanediol as a raw material is preferably used, and a polycarbonate polyol produced using the glycol compound including biomass-derived 1,10-decanediol as a raw material is more preferably used, as the polycarbonate polyol (a1).

From the viewpoint of achieving higher oleic acid resistance and more excellent low-temperature flexibility, additionally, butanediol is preferably used, and 1,4-butanediol is more preferably used as the glycol compound.

In the case where the biomass-derived decanediol and the butanediol are used in combination, the total amount of the biomass-derived decanediol and the butanediol used in the glycol compound is preferably 50 mol % or more, more preferably 70 mol % or more, and still more preferably 80 mol % or more.

In the case where the biomass-derived decanediol (C10) and the butanediol (C4) are used in combination as the glycol compound, the molar ratio [(C4)/(C10)] is preferably within a range of 5/95 to 95/5, more preferably within a range of 50/50 to 98/2, and still more preferably within a range of 75/25 to 95/5, from the viewpoint of achieving higher oleic acid resistance and more excellent low-temperature flexibility.

From the viewpoint of achieving higher oleic acid resistance, more excellent low-temperature flexibility, and higher peel strength, the number average molecular weight of the polycarbonate diol (a1) is preferably within a range of 500 to 100,000, more preferably within a range of 1,000 to 3,000, and still more preferably within a range of 1,500 to 2,500. Note that the number average molecular weight of the polycarbonate diol (a1) is a value determined by gel permeation chromatography (GPC).

Preferable examples of the polycarbonate polyol (a1) that are commercially available include "BENEBiOL NL-2010 DB", manufactured by Mitsubishi Chemical Corporation.

In the polyol (a), besides the polycarbonate polyol (a1), other polyols may be used, if necessary. The content of the polycarbonate polyol (a1) in the polyol (a) is preferably 50% by mass or more, more preferably 70% by mass or more, and still more preferably 80% by mass or more.

Examples of the other polyols that can be used include: polycarbonate polyols other than the polycarbonate polyol (a1), polyester polyols, polyether polyols, and polyacrylic polyols. These polyols may be used alone or in combination of two or more.

Examples of the polyisocyanate (b) that can be used include: aliphatic polyisocyanates, such as hexamethylene diisocyanate and lysine diisocyanate; alicyclic polyisocyanates, such as cyclohexane diisocyanate, isophorone diisocyanate, dicyclohexylmethane diisocyanate, tetramethylxylylene diisocyanate, and norbornene diisocyanate; and aromatic polyisocyanates, such as phenylene diisocyanate, toluene diisocyanate, diphenylmethane diisocyanate, xylylene diisocyanate, naphthalene diisocyanate, polymethylene polyphenyl polyisocyanate, and carbodiimidated diphenylmethane polyisocyanate. These polyisocyanates may be used alone or in combination of two or more.

Among the above-mentioned polyisocyanates, aliphatic polyisocyanates and/or alicyclic polyisocyanates are preferably used, and alicyclic polyisocyanates are more preferably used as the polyisocyanate (b) from the viewpoint of achieving higher oleic acid resistance, more excellent low-temperature flexibility, higher peel strength, and higher light resistance.

The amount of the polyisocyanate (b) used is preferably within a range of 2.5% to 5.0% by mass, and more preferably within a range of 3.0% to 4.0% by mass, based on the total mass of the raw materials constituting the anionic urethane resin (X).

The alkanolamine (c) is an essential component for achieving high peel strength. The alkanolamine has an amino group having higher reactivity with an isocyanate group derived from the polyisocyanate (b) and has a hydroxyl group having lower reactivity with the isocyanate group than the amino group. Hence, the alkanolamine (c) functions not only as a chain extender for producing the urethane resin (X) (the chain extender contributing to the achievement of higher molecular weight and the formation of a hard segment), but also as a stopper. Thus, not only a good hard segment can be formed, but also the molecular weight of the urethane resin (X) can be controlled, so that both high peel strength and high oleic acid resistance and excellent low-temperature flexibility can be achieved.

Examples of the alkanolamine (c) that can be used include: primary alkanolamines, such as monoethanolamine and monoisopropanolamine; secondary alkanolamines, such as diethanolamine, diisopropanolamine, di-2-hydroxybutylamine, N-methylethanolamine, N-ethylethanolamine, and N-benzylethanolamine; and tertiary alkanolamines, such as triethanolamine and tripropanolamine. These alkanolamines may be used alone or in combination of two or more. Among these alkanolamines, primary alkanolamines and/or secondary alkanolamines are preferably used from the viewpoint of achieving higher oleic acid resistance, more excellent low-temperature flexibility, and higher peel strength.

The amount of the alkanolamine (c) used is preferably within a range of 0.1% to 0.95% by mass, and more preferably within a range of 0.7% to 0.9% by mass, based on the total mass of the raw materials constituting the anionic urethane resin (X).

Specific examples of the anionic urethane resin (X) that can be used in the present invention include a reaction product of the polyol (a), the polyisocyanate (b), the alkanolamine (c), an anionic group-containing compound (d), and, if necessary, a chain extender (e).

Examples of the anionic group-containing compound (d) that can be used include: carboxyl group-containing compounds, such as 2,2-dimethylolpropionic acid, 2,2-dimethylolbutanoic acid, 2,2-dimethylolbutyric acid, 2,2-dimethylolpropionic acid, and 2,2-valeric acid; and sulfonyl group-containing compounds, such as 3,4-diaminobutanesulfonic acid, 3,6-diamino-2-toluenesulfonic acid, 2,6-diaminobenzenesulfonic acid, N-(2-aminoethyl)-2-aminosulfonic acid, N-(2-aminoethyl)-2-aminoethylsulfonic acid, N-2-aminoethane-2-aminosulfonic acid, and N-(2-aminoethyl)-β-alanine, and salts thereof. These compounds may be used alone or in combination of two or more.

The amount of the anionic group-containing compound (d) used is preferably within a range of 0.2% to 0.95% by mass, and more preferably within a range of 0.2% to 0.5% by mass, based on the total mass of the raw materials constituting the anionic urethane resin (X).

The chain extender (e) preferably has a molecular weight of less than 500, and more preferably has a molecular weight within a range of 50 to 450. Specific examples of the chain extender (e) that can be used include: a chain extender (e1) having two or more amino groups, such as ethylenediamine, 1,2-propanediamine, 1,6-hexamethylenediamine, 2,5-dimethylpiperazine, isophoronediamine, 1,2-cyclohexanediamine, 1,3-cyclohexanediamine, 1,4-cyclohexanediamine, 4,4'-dicyclohexylmethanediamine, 3,3'-dimethyl-4,4'-dicyclohexylmethanediamine, 1,4-cyclohexanediamine, piperazine, and hydrazine; and a chain extender (e2) having two or more hydroxyl groups, such as ethylene glycol, diethylene glycol, triethylene glycol, propylene glycol, dipropylene glycol, 1,3-propanediol, 1,3-butanediol, 1,4-butanediol, hexamethylene glycol, saccharose, methylene glycol, glycerin, sorbitol, bisphenol A, 4,4'-dihydroxydiphenyl, 4,4'-dihydroxydiphenyl ether, and trimethylolpropane. These chain extenders may be used alone or in combination of two or more. Note that the molecular weight of the chain extender (e) is a chemical formula weight calculated from a chemical formula.

From the viewpoint of achieving more excellent low-temperature flexibility and higher peel strength, among the above-mentioned chain extenders, a chain extender that is produced using the chain extender (e1) having two or more amino groups as a raw material and not using the chain extender (e2) having two or more hydroxyl groups as a raw material is preferably employed as the chain extender (e). As the chain extender (e1), piperazine and/or hydrazine are preferably used.

In the case of using the chain extender (e1), the equivalent ratio [(c)/(e1)] of the alkanolamine (c) to the chain extender (e1) is preferably within a range of 1.1/0.3 to 0.7/0.2, and more preferably within a range of 1.0/0.2 to 0.8/0.1 from the viewpoint of achieving more excellent low-temperature flexibility and higher peel strength.

The amount of the chain extender (e) used is preferably within a range of 0.001% to 0.1% by mass, and more preferably within a range of 0.01% to 0.050% by mass, based on the total mass of the raw materials constituting the anionic urethane resin (X).

Examples of a method for producing the anionic urethane resin (X) include: a method in which the polyol (a) as a raw material, the polyisocyanate (b), the alkanolamine (c), the anionic group-containing compound (d), and, if necessary, the chain extender (e) are mixed at once and allowed to react; and a method in which the polyol (a), the polyisocyanate (b), and the anionic group-containing compound (d) are allowed to react to obtain a urethane prepolymer having an isocyanate group, and subsequently the urethane prepolymer is allowed to react with the alkanolamine (c) and the chain extender (e). Of these methods, the latter method is preferably employed from the viewpoint of ease of reaction control.

Each of the reactions is performed, for example, at a temperature of 50° C. to 100° C. for 30 minutes to 10 hours.

When the anionic urethane resin (X) is produced, an organic solvent may be used. Examples of the organic solvent that can be used include: ketone compounds, such as acetone and methyl ethyl ketone; ether compounds, such as tetrahydrofuran and dioxane; acetate compounds, such as ethyl acetate and butyl acetate; nitrile compounds, such as acetonitrile; and amide compounds, such as dimethylformamide and N-methylpyrrolidone. These organic solvents may be used alone or in combination of two or more. Note that the organic solvent is preferably removed in the end, for example, by a distillation method.

From the viewpoint of achieving higher peel strength, the weight-average molecular weight of the anionic urethane resin (X) is preferably within a range of 15,000 to 70,000, and more preferably within a range of 15,000 to 35,000. Note that the weight-average molecular weight of the anionic urethane resin (X) is a value determined by GPC.

The content of the urethane resin (X) in the urethane resin composition is, for example, within a range of 10% to 60% by mass.

Examples of the water (Y) that can be used include ion-exchanged water and distilled water. These types of water may be used alone or in combination of two or more. The content of the water (Y) is, for example, within a range of 35% to 85% by mass.

The urethane resin composition according to the present invention includes the anionic urethane resin (X) and the water (Y), and may further include other additives, if necessary.

Examples of the other additives that can be used include a neutralizer, an emulsifier, a cross-linking agent, a thickener, a urethanization catalyst, a filler, a foaming agent, a pigment, a dye, an oil repellent, a hollow foam, a flame retardant, a defoaming agent, a leveling agent, and an anti-blocking agent. These additives may be used alone or in a combination of two or more.

Furthermore, the acid value of the anionic urethane resin (X) is preferably 35 mgKOH/g or less, and more preferably within a range of 1 mgKOH/g to 20 mgKOH/g from the viewpoint of achieving higher hydrolysis resistance, higher oleic acid resistance, more excellent low-temperature flexibility, and higher peel strength. The acid value of the anionic urethane resin (X) can be adjusted by making use of the amount of the anionic group-containing compound (d) used as a raw material. Note that a method for measuring the acid value of the anionic urethane resin (X) will be described later in Examples.

The skin layer (iii) to be used in the present invention is formed from a urethane resin composition including: an anionic urethane resin (S) produced using a specific raw material; and water (T).

To achieve high oleic acid resistance, excellent low-temperature flexibility, and high light resistance, the anionic urethane resin (S) is produced using, as essential raw materials, a polycarbonate polyol (A-1) produced using biomass-derived decanediol as a raw material, and a polycarbonate polyol (A-2) produced using a biomass-derived dihydroxy compound having a cyclic ether structure as a raw material.

From the viewpoint of achieving higher oleic acid resistance, more excellent low-temperature flexibility, and higher light resistance, the mass ratio [ (A-1)/(A-2)] of the polycarbonate polyol (A-1) to the polycarbonate polyol (A-2) is preferably within a range of 98/2 to 40/60, and more preferably within a range of 95/5 to 60/40.

As the polycarbonate polyol (A-1) produced using the biomass-derived decanediol as a raw material, for example, a reaction product of a glycol compound including the biomass-derived decanediol with carbonate and/or phosgene can be used, and specifically, a polycarbonate polyol described in Japanese Unexamined Patent Application Publication No. 2018-127758 can be used.

From the viewpoint of achieving higher oleic acid resistance and more excellent low-temperature flexibility, 1,10-decanediol is preferably used as the decanediol.

Examples of a glycol compound that can be used, other than the decanediol, include ethylene glycol, propylene glycol, 1,3-propanediol, 1,4-butanediol, 1,3-butanediol, 1,2-butanediol, 2-methyl-1,3-propanediol, 1,5-pentanediol, neopentyl glycol, 1,6-hexanediol, 1,5-hexanediol, 3-methyl-1,5-pentanediol, 2-methyl-1,8-octanediol, 1,7-heptanediol, 1,8-octanediol, 1,9-nonanediol, 1,8-nonanediol, 2-ethyl-2-butyl-1,3-propanediol, 1,12-dodecanediol, 1,4-cyclohexanedimethanol, 1,3-cyclohexanedimethanol, trimethylolpropane, trimethylolethane, glycerin, ε-caprolactone, and neopentylglycol. These compounds may be used alone or in combination of two or more. Of these compounds, butanediol is preferably used, and 1,4-butanediol is more preferably used, from the viewpoint of achieving higher oleic acid resistance and more excellent low-temperature flexibility.

In the case where the biomass-derived decanediol and the butanediol are used in combination, the total amount of the biomass-derived decanediol and the butanediol used in the glycol compound is preferably 50 mol % or more, more preferably 70 mol % or more, and still more preferably 80 mol % or more.

In the case where the biomass-derived decanediol (C10) and the butanediol (C4) are used in combination, the molar ratio [(C4)/(C10)] is preferably within a range of 50/50 to 98/2, and more preferably within a range of 75/25 to 95/5, from the viewpoint of achieving higher oleic acid resistance and more excellent low-temperature flexibility.

Examples of the carbonate that can be used include dimethyl carbonate, diethyl carbonate, diphenyl carbonate, ethylene carbonate, and propylene carbonate. These compounds may be used alone or in combination of two or more.

From the viewpoint of achieving higher oleic acid resistance and more excellent low-temperature flexibility, the number average molecular weight of the polycarbonate diol (A-1) is preferably within a range of 500 to 100,000, more preferably within a range of 700 to 10,000, and still more preferably within a range of 1,500 to 4,000. Note that the number average molecular weight of the polycarbonate diol (A-1) is a value determined by GPC.

Preferable examples of the polycarbonate polyol (A-1) that are commercially available include "BENEBiOL NL-3010 DB", manufactured by Mitsubishi Chemical Corporation.

As the polycarbonate polyol (A-2) produced using the biomass-derived dihydroxy compound having the cyclic ether structure as a raw material, for example, a reaction product of a glycol compound including the biomass-derived dihydroxy compound having the cyclic ether structure with carbonate and/or phosgene can be used, and specifically, a polycarbonate polyol described in Japanese Unexamined Patent Application Publication No. 2017-133024 can be used.

Examples of the dihydroxy compound having the cyclic ether structure that can be used include isosorbide, isomannide, and isoidide. These compounds may be used alone or in combination of two or more. Of these compounds, isosorbide is preferably used from the viewpoint of achieving higher light resistance and higher abrasion resistance.

Examples of a glycol compound that can be used, other than the dihydroxy compound, include ethylene glycol, propylene glycol, 1,3-propanediol, 1,4-butanediol, 1,3-butanediol, 1,2-butanediol, 2-methyl-1,3-propanediol, 1,5-pentanediol, neopentyl glycol, 1,6-hexanediol, 1,5-hexanediol, 3-methyl-1,5-pentanediol, 2-methyl-1,8-octanediol, 1,7-heptanediol, 1,8-octanediol, 1,9-nonanediol, 1,8-nonanediol, 2-ethyl-2-butyl-1,3-propanediol, 1,12-dodecanediol, 1,4-cyclohexanedimethanol, 1,3-cyclohexanedimethanol, trimethylolpropane, trimethylolethane, glycerin, ε-caprolactone, and neopentyl glycol. These compounds may be used alone or in combination of two or more. Of these compounds, butanediol and/or hexanediol are preferably used from the viewpoint of achieving higher light resistance and higher abrasion resistance.

In the case where the biomass-derived dihydroxy compound having the cyclic ether structure and the butanediol and/or the hexanediol are used in combination, the total amount of the biomass-derived dihydroxy compound and the butanediol and/or the hexanediol used in the glycol compound is preferably 50 mol % or more, more preferably 70 mol % or more, and still more preferably 80 mol % or more.

In the case where the glycol compound (ISB) that can be used, other than the biomass-derived dihydroxy compound, and butanediol (C4) and/or hexanediol (C6) are used in combination, the molar ratio [(C4+C6)/(ISB)] is preferably within a range of 30/70 to 90/10, more preferably within a range of 40/60 to 80/20, and still more preferably within a range of 50/50 to 70/30, from the viewpoint of achieving higher oleic acid resistance, more excellent low-temperature flexibility, higher light resistance, and higher abrasion resistance.

Examples of the carbonate that can be used include dimethyl carbonate, diethyl carbonate, diphenyl carbonate, ethylene carbonate, and propylene carbonate. These compounds may be used alone or in combination of two or more.

From the viewpoint of achieving hither light resistance and higher abrasion resistance, the number average molecular weight of the polycarbonate diol (A-2) is preferably within a range of 400 to 100,000, more preferably within a range of 450 to 5,000, and still more preferably within a range of 500 to 2,000. Note that the number average molecular weight of the polycarbonate diol (A-2) is a value determined by GPC.

Preferable examples of the polycarbonate polyol (A-2) that are commercially available include "BENEBiOL HS0830B", "BENEBiOL HS0840B", "BENEBiOL HS0840H", and "BENEBiOL HS0850H", manufactured by Mitsubishi Chemical Corporation.

Specific examples of the anionic urethane resin (S) that can be used include a reaction product of the polyol (A), the polyisocyanate (B), an anionic group-containing compound (C), and, if necessary, a chain extender (D).

Examples of polyols that can be used as the polyol (A), other than the polycarbonate polyols (A-1) and (A-2), include polyester polyols, polyether polyols, polybutadiene polyols, and polycarbonate polyols other than the polycarbonate polyols (A-1) and (A-2). These polyols may be used alone or in combination of two or more.

The total amount of the polycarbonate polyol (A-1) and the polycarbonate polyol (A-2) used in the polyol (A) is preferably 60% by mass or more, more preferably 80% by mass or more, still more preferably 90% by mass or more, and particularly preferably 95% by mass or more.

The amount of the polyol (A) used is preferably within a range of 73.4% to 85.3% by mass, and more preferably within a range of 76.9% to 81.2% by mass, based on the total amount of the raw materials constituting the anionic urethane resin (S).

Examples of the polyisocyanate (B) that can be used include: aliphatic polyisocyanates, such as hexamethylene diisocyanate and lysine diisocyanate; alicyclic polyisocyanates, such as cyclohexane diisocyanate, isophorone diisocyanate, dicyclohexylmethane diisocyanate, tetramethylxylylene diisocyanate, and norbornene diisocyanate; phenylene diisocyanate, toluene diisocyanate, diphenylmethane diisocyanate, xylylene diisocyanate, naphthalene diisocyanate, polymethylene polyphenyl polyisocyanate, and carbodiimidated diphenylmethane polyisocyanate. These polyisocyanates may be used alone or in combination of two or more.

The amount of the polyisocyanate (B) used is preferably within a range of 14.1% to 23.8% by mass, and more preferably within a range of 17.7% to 21.0% by mass, based on the total amount of the raw materials constituting the anionic urethane resin (S).

Examples of the anionic group-containing compound (C) that can be used include: carboxyl group-containing compounds, such as 2,2-dimethylolpropionic acid, 2,2-dimethylolbutanoic acid, 2,2-dimethylolbutyric acid, 2,2-dimethylolpropionic acid, and 2,2-valeric acid; and sulfonyl group-containing compounds, such as 3,4-diaminobutanesulfonic acid, 3,6-diamino-2-toluenesulfonic acid, 2,6-diaminobenzenesulfonic acid, N-(2-aminoethyl)-2-aminosulfonic acid, N-(2-aminoethyl)-2-aminoethylsulfonic acid, N-2-aminoethane-2-aminosulfonic acid, and N-(2-aminoethyl)-β-alanine, and salts thereof. These compounds may be used alone or in combination of two or more.

The amount of the anionic group-containing compound (C) used is preferably within a range of 1.3% to 3.9% by mass, and more preferably within a range of 2.2% to 3.2% by mass, based on the total amount of the raw materials constituting the anionic urethane resin (S).

The chain extender (D) has a molecular weight of less than 500 (preferably within a range of 50 to 450). Examples of the chain extender (D) that can be used include: amino group-containing chain extenders (d1), such as ethylenediamine, 1,2-propanediamine, 1,6-hexamethylenediamine, piperazine, 2,5-dimethylpiperazine, isophoronediamine, 1,2-cyclohexanediamine, 1,3-cyclohexanediamine, 1,4-cyclohexanediamine, 4,4'-dicyclohexylmethanediamine, 3,3'-dimethyl-4,4'-dicyclohexylmethanediamine, 1,4-cyclohexanediamine, and hydrazine; and hydroxyl group-containing chain extenders (a2-1), such as ethylene glycol, diethylene glycol, triethylene glycol, propylene glycol, dipropylene glycol, 1,3-propanediol, 1,3-butanediol, 1,4-butanediol, hexamethylene glycol, saccharose, methylene glycol, glycerin, sorbitol, bisphenol A, 4,4'-dihydroxydiphenyl, 4,4'-dihydroxydiphenyl ether, and trimethylolpropane. These chain extenders may be used alone or in combination of two or more. Note that the molecular weight of the chain extender (D) is a chemical formula weight calculated from a chemical formula.

As the chain extender (D), the amino group-containing chain extenders (d1) are preferably used, and piperazine and/or isophoronediamine are more preferably used, from the viewpoint of achieving higher oleic acid resistance and more excellent low-temperature flexibility.

The amount of the chain extender (D) used is preferably within a range of 0.54% to 2.78% by mass, and more preferably within a range of 1.20% to 2.04% by mass, based on the total amount of the raw materials constituting the anionic urethane resin (S).

Examples of a method for producing the anionic urethane resin (S) include: a method in which the polyol (A) as a raw material, the polyisocyanate (B), the anionic group-containing compound (C), and, if necessary, the chain extender (D) are mixed at once and allowed to react; and a method in which the polyol (A), the polyisocyanate (B), and the anionic group-containing compound (C) are allowed to react to obtain a urethane prepolymer having an isocyanate group, and subsequently the urethane prepolymer is allowed to react with the chain extender (D). Of these methods, the latter method is preferably employed from the viewpoint of ease of reaction control.

Each of the above-mentioned reactions is performed, for example, at a temperature of 50° C. to 100° C. for 30 minutes to 10 hours.

When the anionic urethane resin (S) is produced, an isocyanate group remaining in the anionic urethane resin (X) may be deactivated. To deactivate the isocyanate group, an alcohol having one hydroxyl group, such as methanol, is preferably used. The amount of the alcohol used is, for example, within a range of 0.001 to 10 parts by mass with respect to 100 parts by mass of the anionic urethane resin (S).

When the anionic urethane resin (S) is produced, an organic solvent may be used. Examples of the organic solvent that can be used include: ketone compounds, such as acetone and methyl ethyl ketone; ether compounds, such as tetrahydrofuran and dioxane; acetate compounds, such as ethyl acetate and butyl acetate; nitrile compounds, such as acetonitrile; and amide compounds, such as dimethylformamide and N-methylpyrrolidone. These organic solvents may be used alone or in combination of two or more. Note that the organic solvent is preferably removed in the end, for example, by a distillation method.

The content of the urethane resin (S) in the urethane resin composition is, for example, within a range of 10% to 60% by mass.

Examples of the water (T) that can be used include ion-exchanged water and distilled water. These types of water may be used alone or in combination of two or more. The content of the water (T) is, for example, within a range of 35% to 85% by mass.

The urethane resin composition according to the present invention includes the anionic urethane resin (S) and the water (T), and may further include other additives, if necessary.

Examples of the other additives that can be used include a neutralizer, a cross-linking agent, a thickener, a urethanization catalyst, a filler, a foaming agent, a pigment, a dye, an oil repellent, a hollow foam, a flame retardant, a defoaming agent, a leveling agent, and an anti-blocking agent. These additives may be used alone or in a combination of two or more.

Note that, in the present invention, from the viewpoint of achieving higher hydrolysis resistance, higher oleic acid resistance, and more excellent low-temperature flexibility, the urethane resin composition is preferably devoid of an emulsifier (U).

Examples of the emulsifier (U) include: nonionic emulsifiers, such as polyoxyethylene nonylphenyl ether, polyoxyethylene lauryl ether, polyoxyethylene styrylphenyl ether, polyoxyethylene sorbitol tetraoleate, and polyoxyethylene-polyoxypropylene copolymers; anionic emulsifiers, such as fatty acid salts including sodium oleate, alkyl sulfates, alkyl benzenesulfonates, alkyl sulfosuccinates, naphthalene sulfonates, polyoxyethylene alkyl sulfates, sodium alkane sulfonates, and sodium alkyl diphenyl ether sulfonates; and cationic emulsifiers, such as alkyl amine salts, alkyl trimethyl ammonium salts, and alkyl dimethyl benzyl ammonium salts.

The acid value of the anionic urethane resin (S) is preferably within a range of 5 to 15 mgKOH/g from the viewpoint of achieving higher hydrolysis resistance, higher oleic acid resistance, and more excellent low-temperature flexibility, and also achieving good emulsifiability even without using the emulsifier (U) and achieving liquid stability after emulsification. The acid value of the anionic urethane resin (S) can be adjusted using the amount of the anionic group-containing compound (C) used as a raw material. Note that a method for measuring the acid value of the anionic urethane resin (S) will be described later in Examples.

Next, the synthetic leather according to the present invention will be described.

The synthetic leather according to the present invention includes at least the substrate (i), the adhesive layer (ii), and the skin layer (iii). Specifically, the synthetic leather includes the following constituents, for example.

(1) the substrate (i), the adhesive layer (ii), and the skin layer (iii)

(2) the substrate (i), the adhesive layer (ii), an intermediate layer, and the skin layer (iii)

(3) the substrate (i), a porous layer, the adhesive layer (ii), and the skin layer (iii)

(4) the substrate (i), the porous layer, the adhesive layer (ii), the intermediate layer, and the skin layer (iii)

Examples of the porous layer that can be used include a solvent-based urethane resin composition formed by a known wet film forming method; and a water-based urethane resin composition made porous by a known method.

Examples of a material that can be used for forming the intermediate layer include known water-based urethane resins, solvent-based urethane resins, solvent-free urethane resins, water-based acrylic resins, silicone resins, polypropylene resins, and polyester resins. These resins may be used alone or in combination of two or more.

Optionally, a surface treatment layer may be disposed on the skin layer (iii) to prevent, for example, scratching. Examples of a material that can be used for forming the surface treatment layer include known water-based urethane resins, solvent-based urethane resins, solvent-free urethane resins, water-based acrylic resins, silicone resins, polypropylene resins, and polyester resins. These resins may be used alone or in combination of two or more.

Next, a method for producing the synthetic leather according to the present invention will be described.

Examples of the method for producing the synthetic leather include a method in which a skin layer-forming urethane resin composition is applied to a substrate that has been subjected to releasing treatment, and dried and processed to obtain the skin layer (iii), and subsequently, an adhesive layer-forming urethane resin composition is applied to the skin layer (iii) and dried to form the adhesive layer (ii), and then the resultant is laminated to the substrate (i). Alternatively, another method may be used in which an adhesive layer-forming urethane resin composition is applied to the skin layer (iii), and the resultant is laminated to the substrate (i) and then dried to form the adhesive layer (ii).

The application of the skin layer-forming or the adhesive layer-forming urethane resin composition may be performed using an applicator, a roll coater, a spray coater, a T-die coater, a knife coater, or a comma coater.

The drying of the urethane resin compositions may be performed, for example, at a temperature of 40° C. to 130° C. for 1 to 10 minutes. The thicknesses of the obtained adhesive layer (ii) and skin layer (iii) are determined as appropriate in accordance with the application in which the synthetic leather is used, and are, for example within a range of 0.5 to 100 μm.

Subsequent to the production of the synthetic leather, for example, aging may be performed at a temperature of 30° C. to 100° C. for 1 to 10 days as needed.

The synthetic leather according to the present invention is an environmentally friendly synthetic leather in which the adhesive layer and the skin layer are both formed from respective water-containing urethane resin compositions. Furthermore, both the adhesive layer and the skin layer are produced from biomass materials, hence, also in this respect, the synthetic leather is friendly to the environment. Furthermore, the synthetic leather according to the present invention has high oleic acid resistance, excellent low-temperature flexibility, high peel strength, and high light resistance.

EXAMPLES

Hereinafter, the present invention will be described in more detail by way of Examples.

[Synthesis Example 1] Preparation of Adhesive Layer-Forming Urethane Resin Composition (X-1)

A four-neck flask equipped with a stirrer, a reflux condenser, a thermometer, and a nitrogen gas introduction tube was charged, under a nitrogen flow, with 300 parts by mass of a polycarbonate polyol ("BENEBiOL NL-2010 DB" manufactured by Mitsubishi Chemical Corporation, produced using 1,4-butanediol and biomass-derived 1,10-decanediol as raw materials, number average molecular weight: 2,000), 380 parts by mass of methyl ethyl ketone, and 9.2 parts by mass of 2,2-dimethylolpropionic acid. The mixture was sufficiently stirred and mixed. Then, 68 parts by mass of isophorone diisocyanate was added to the mixture, and subsequently 0.1 part by mass of bismuth carboxylate was added thereto. The resultant mixture was allowed to react at 75° C. for 4 hours, whereby a methyl ethyl ketone solution of a urethane prepolymer having an isocyanate group was obtained.

Subsequently, 8.4 parts by mass of triethylamine was added to the obtained methyl ethyl ketone solution of the urethane prepolymer to neutralize a carboxyl group in the urethane prepolymer. After the completion of the neutralization, 690 parts by mass of ion-exchanged water was added, and then 0.76 part by mass of piperazine and 8.3 parts by mass of monoethanolamine (hereinafter abbreviated as "MEA") were added, and the resultant mixture was allowed to react. After the completion of the reaction, methyl ethyl ketone (MEK) was removed by evaporation under reduced pressure, whereby an adhesive layer-forming urethane resin composition (X-1) was obtained. The obtained urethane resin had an acid value of 10.3 mgKOH/g and a weight-average molecular weight of 30,000.

[Synthesis Example 2] Preparation of Adhesive Layer-Forming Urethane Resin Composition (X-2)

An adhesive layer-forming urethane resin composition (X-2) was obtained in the same manner as in Example 1, except that diethanolamine was used in place of MEA. The obtained urethane resin had an acid value of 10.3 mgKOH/g and a weight-average molecular weight of 25,000.

[Synthesis Example 3] Preparation of Skin Layer-Forming Urethane Resin Composition (S-1)

A four-neck flask equipped with a stirrer, a reflux condenser, a thermometer, and a nitrogen gas introduction tube was charged, under a nitrogen flow, with 100 parts by mass of polycarbonate diol produced using 1,4-butanediol and biomass-derived 1,10-decanediol as raw materials (molar ratio [(C4)/(C10)]=90/10, number average molecular weight: 3,000) and 11.1 parts by mass of polycarbonate diol produced using 1,4-butanediol and biomass-derived isosorbide as raw materials (molar ratio [(C4)/(ISB)]=60/40, number average molecular weight: 800), and furthermore charged with 194 parts by mass of methyl ethyl ketone and 4.4 parts by mass of 2,2-dimethylolpropionic acid. The mixture was sufficiently stirred and mixed. Then, 29.4 parts by mass of dicyclohexylmethane diisocyanate (hereinafter abbreviated as "HMDI") was added to the mixture, and subsequently 0.03 part by mass of bismuth carboxylate was added thereto. The resultant mixture was allowed to react at 75° C. for approximately 4 hours, whereby a methyl ethyl ketone solution of a urethane prepolymer having an isocyanate group was obtained.

Subsequently, 4.0 parts by mass of triethylamine was added to the methyl ethyl ketone solution to neutralize a carboxyl group in the urethane prepolymer. After the completion of the neutralization, 460 parts by mass of ion-exchanged water was added, and then 2.2 parts by mass of piperazine (hereinafter abbreviated as "Pip") was added, and the resultant mixture was allowed to react. After the completion of the reaction, methyl ethyl ketone was removed by evaporation under reduced pressure, whereby a skin layer-forming urethane resin composition (S-1) (acid value: 13 mgKOH/g) was obtained.

[Synthesis Example 4] Preparation of Skin Layer-Forming Urethane Resin Composition (S-2)

In Example 1, a skin layer-forming urethane resin composition (S-2) (acid value: 13 mgKOH/g) was obtained in the same manner as in Synthesis Example 4, except that 29.4 parts by mass of HMDI was changed to 24.9 parts by mass of isophorone diisocyanate, and 2.2 parts by mass of Pip was changed to 2.6 parts by mass of Pip.

[Comparative Synthesis Example 1] Preparation of Adhesive Layer-Forming Urethane Resin Composition (XR-1)

A four-neck flask equipped with a stirrer, a reflux condenser, a thermometer, and a nitrogen gas introduction tube was charged, under a nitrogen flow, with 300 parts by mass of a polycarbonate polyol ("BENEBiOL NL-2010 DB" manufactured by Mitsubishi Chemical Corporation, produced using 1,4-butanediol and biomass-derived 1,10-decanediol as raw materials, number average molecular weight: 2,000), 400 parts by mass of methyl ethyl ketone, and 16 parts by mass of 2,2-dimethylolpropionic acid. The mixture was sufficiently stirred and mixed. Then, 83 parts by mass of isophorone diisocyanate was added to the mixture, and subsequently 0.1 part by mass of bismuth carboxylate was added thereto. The resultant mixture was allowed to react at 75° C. for 4 hours, whereby a MEK solution of a urethane prepolymer having an isocyanate group was obtained.

Subsequently, 14.3 parts by mass of triethylamine was added to the obtained methyl ethyl ketone solution of the urethane prepolymer to neutralize a carboxyl group in the urethane prepolymer. After the completion of the neutralization, 630 parts by mass of ion-exchanged water was added, and then 6.42 parts by mass of PiP was added, and the resultant mixture was allowed to react. After the completion of the reaction, MEK was removed by evaporation under reduced pressure, whereby an adhesive layer-forming urethane resin composition (XR-1) was obtained. The obtained urethane resin had an acid value of 10.3 mgKOH/g and a weight-average molecular weight of 150,000.

[Comparative Synthesis Example 2] Preparation of Skin Layer-Forming Urethane Resin Composition (SR-1)

A four-neck flask equipped with a stirrer, a reflux condenser, a thermometer, and a nitrogen gas introduction tube was charged with 100 parts by mass of polycarbonate diol produced using 1,4-butanediol and biomass-derived 1,10-decanediol as raw materials (molar ratio [(C4)/(C10)]=90/10, number average molecular weight: 3,000) and furthermore charged with 170 parts by mass of methyl ethyl ketone and 4.0 parts by mass of 2,2-dimethylolpropionic acid. The mixture was sufficiently stirred and mixed. Then, 23.1 parts by mass of dicyclohexylmethane diisocyanate was added to the mixture, and subsequently 0.03 part by mass of bismuth carboxylate was added thereto. The resultant mixture was allowed to react at 75° C. for approximately 4 hours, whereby a methyl ethyl ketone solution of a urethane prepolymer having an isocyanate group was obtained.

Subsequently, 3.6 parts by mass of triethylamine was added to the methyl ethyl ketone solution to neutralize a carboxyl group in the urethane prepolymer. After the completion of the neutralization, 404 parts by mass of ion-exchanged water was added, and then 1.7 parts by mass of Pip was added, and the resultant mixture was allowed to react. After the completion of the reaction, methyl ethyl ketone was removed by evaporation under reduced pressure, whereby a urethane resin composition (SR-1) (acid value: 17 mgKOH/g) was obtained.

[Method for Measuring Number Average Molecular Weight and Weight-Average Molecular Weight]

The number average molecular weight of each of the polyols and the weight-average molecular weight of each of the anionic urethane resins that are used in Synthesis Examples and Comparative Synthesis Examples are determined by GPC under the following conditions.

Measurement Device: High performance GPC ("HLC-8220GPC", manufactured by Tosoh Corporation)

Columns: The following columns manufactured by Tosoh Corporation were connected in series and used.

"TSKgel G5000" (7.8 mm I.D.×30 cm)×1
"TSKgel G4000" (7.8 mm I.D.×30 cm)×1
"TSKgel G3000" (7.8 mm I.D.×30 cm)×1
"TSKgel G2000" (7.8 mm I.D.×30 cm)×1

Detector: RI (differential refractometer)
Column temperature: 40° C.
Eluent: tetrahydrofuran (THE)
Flow Rate: 1.0 mL/minute
Injection Amount: 100 μL (a tetrahydrofuran solution having a sample concentration of 0.4% by mass)
Standard samples: The following types of standard polystyrene were used to produce a calibration curve.

(Standard Polystyrene)

"TSKgel standard polystyrene A-500", manufactured by Tosoh Corporation
"TSKgel standard polystyrene A-1000", manufactured by Tosoh Corporation
"TSKgel standard polystyrene A-2500", manufactured by Tosoh Corporation
"TSKgel standard polystyrene A-5000", manufactured by Tosoh Corporation
"TSKgel standard polystyrene F-1", manufactured by Tosoh Corporation
"TSKgel standard polystyrene F-2", manufactured by Tosoh Corporation
"TSKgel standard polystyrene F-4", manufactured by Tosoh Corporation
"TSKgel standard polystyrene F-10", manufactured by Tosoh Corporation
"TSKgel standard polystyrene F-20", manufactured by Tosoh Corporation
"TSKgel standard polystyrene F-40", manufactured by Tosoh Corporation
"TSKgel standard polystyrene F-80", manufactured by Tosoh Corporation
"TSKgel standard polystyrene F-128", manufactured by Tosoh Corporation
"TSKgel standard polystyrene F-288", manufactured by Tosoh Corporation
"TSKgel standard polystyrene F-550", manufactured by Tosoh Corporation

[Method for Measuring Acid Values of Anionic Urethane Resins (X) and (S)]

Each of the urethane resin compositions obtained in Synthesis Examples and Comparative Synthesis Examples was dried, and 0.05 g to 0.5 g of the dried and solidified resin particles were weighed into a 300-mL Erlenmeyer flask. Subsequently, approximately 80 mL of a solvent mixture of tetrahydrofuran and ion-exchanged water at a mass ratio [tetrahydrofuran/ion-exchanged water] of 80/20 was added, whereby a mixed solution thereof was obtained.

Next, a phenolphthalein indicator was mixed with the mixed solution. Then, the resultant mixture was titrated with a 0.1-mol/L aqueous solution of potassium hydroxide standardized in advance. The acid value (mgKOH/g) of an aqueous urethane resin (A) was determined in accordance with the following computational formula (1) by using the amount of the aqueous solution of potassium hydroxide used for the titration.

$$\text{Computational Formula } A=(B\times f\times 5.611)/S \quad (1)$$

In the computational formula (1), A is a solid content acid value (mgKOH/g) of the resin; B is an amount (mL) of the 0.1-mol/L aqueous solution of potassium hydroxide used for the titration; f is a factor of the 0.1-mol/L aqueous solution of potassium hydroxide; S is a mass (g) of the resin particles: and 5.611 is a formula weight of potassium hydroxide (56.11/10).

[Example 1] Production of Synthetic Leather (1)

100 parts by mass of the skin layer-forming urethane resin composition (S-1) obtained in Synthesis Example 3, 10 parts by mass of a black pigment ("DILAC HS-9530", manufactured by DIC Corporation), and 1 part by mass of a thickener ("HYDRAN ASSISTER T10", manufactured by DIC Corporation) were mixed to obtain a liquid mixture. The liquid mixture was applied to a flat release paper sheet ("DN-TP-155T", manufactured by Ajinomoto Co., Inc.) so as to achieve a dry film thickness of 30 μm, and dried at 70° C. for 2 minutes, then dried at 120° C. for 2 minutes, whereby a skin layer was obtained.

Subsequently, 100 parts by mass of the adhesive layer-forming urethane resin composition (X-1) obtained in Synthesis Example 1, 1 part by mass of a thickener ("HYDRAN ASSISTER T10", manufactured by DIC Corporation), and 9 parts by mass of a polyisocyanate cross-linking agent ("HYDRAN ASSISTER C5", manufactured by DIC Corporation) were mixed to obtain a liquid mixture. The liquid mixture was applied to the skin layer so as to achieve a dry film thickness of 50 μm, and dried at 70° C. for 3 minutes. Immediately after the drying, a nonwoven fabric impregnated with polyurethane was laminated to the resultant, and then the laminate was heat-treated at 120° C. for 2 minutes. Subsequently the laminate was aged at 50° C. for 2 days, and then the release paper sheet was peeled off to obtain a synthetic leather.

Examples 2 to 4, Comparative Example 1

Synthetic leathers (2) to (4) and (R1) were obtained in the same manner as in Example 1, except that the types of the skin layer-forming urethane resin composition and the adhesive layer-forming urethane resin composition to be used were changed as illustrated in Table 1.

[Method for Evaluating Oleic Acid Resistance]

The synthetic leathers obtained in Examples and Comparative Example were each cut into strips having a width of 5 mm and a length of 50 mm, and the strips were used as test specimens. Using a tensile tester ("Autograph AG-I", manufactured by Shimadzu Corporation), one of the test specimens was subjected to a tensile test under the conditions of a chuck distance of 40 mm, a tensile speed of 10 mm/second, and a temperature of 23° C. to measure a stress at 100% elongation (100% modulus, hereinafter referred to as "100% M (1)").

Subsequently, another one of the test specimens was immersed in oleic acid at 23° C. for 24 hours. Then, the test specimen was taken out, and oleic acid attached to a surface of the test specimen was wiped away. Then, a 100% modulus value (hereinafter referred to as "100% M (2)") was measured in the same manner as for the 100% M (1). Retention was calculated by dividing the 100% M (2) by the 100% M (1), and evaluated as follows.

"A": The retention was 50% or more.

"B": The retention was 30% or more and less than 50%.

"C": The retention was less than 30%.

[Method for Evaluating Low-Temperature Flexibility]

Each of the synthetic leathers obtained in Examples and Comparative Example was subjected to a flexibility test (at −10° C., 100 times per minute) using a flexometer ("flexometer equipped with cryostat" manufactured by YASUDA SEIKI SEISAKUSHO, LTD.), and the number of times of the test performed until a crack appeared in a surface of the synthetic leather was measured, and the low-temperature flexibility was evaluated in accordance with the following criteria.

"A": 30,000 times or more

"B": 10,000 times or more and less than 30,000 times

"C": less than 10,000 times

[Method for Measuring Peel Strength]

The peel strength of each of the synthetic leathers obtained in Examples and Comparative Example was measured using Shimadzu Autograph "AG-1" (manufactured by Shimadzu Corporation) under the conditions of a full scale of 5 kg and a head speed of 20 mm/min, and evaluated in accordance with the following criteria.

"A": 1.0 kgf/cm or more

"B": 0.5 kgf/cm or more and less than 1.0 kgf/cm

"C": less than 0.5 kgf/cm

[Methods for Evaluating Light Resistance]

Each of the synthetic leathers obtained in Examples and Comparative Example was exposed to 650 ppm NOx gas for 1 hour, and evaluated based on the degree of yellowing after the exposure in accordance with the following criteria.

"A": No yellowing was observed in appearance.

"B": Slight yellowing was observed in appearance.

"C": A dark yellow color was observed in appearance.

TABLE 1

| Table 1 | Example 1 | Example 2 | Example 3 | Example 4 | Comparative Example 1 |
|---|---|---|---|---|---|
| Synthetic Leather | (1) | (2) | (3) | (4) | (R1) |
| Adhesive Layer (ii) | (X-1) | (X-1) | (X-2) | (X-2) | (XR-1) |
| Skin Layer (iii) | (S-1) | (S-2) | (S-1) | (S-2) | (SR-1) |
| Evaluation | | | | | |
| Oleic Acid Resistance | A | A | A | A | C |
| Low-Temperature Flexibility | A | A | A | A | C |

TABLE 1-continued

| Table 1 | Example 1 | Example 2 | Example 3 | Example 4 | Comparative Example 1 |
|---|---|---|---|---|---|
| Peel Strength | A | A | A | A | C |
| Light Resistance | A | A | A | A | C |

It was found that the synthetic leather according to the present invention, which was an environmentally friendly synthetic leather produced using water and a biomass raw material, had high oleic acid resistance, excellent low-temperature flexibility, high peel strength, and high light resistance.

In contrast, Comparative Example 1, in which a urethane resin composition not including alkanolamine (c) was used as the adhesive layer (ii) and a urethane resin composition not including polycarbonate polyol (A-2) was used as the skin layer (iii), had poor oleic acid resistance, poor low-temperature flexibility, poor peel strength and poor light resistance.

The invention claimed is:

1. A synthetic leather, comprising at least:

a substrate (i);

an adhesive layer (ii); and a skin layer (iii), wherein the adhesive layer (ii) is formed from a urethane resin composition, the urethane resin composition including an anionic urethane resin (X) and water (Y), the anionic urethane resin (X) is produced using, as essential raw materials, a polyol (a) including a biomass-derived polycarbonate polyol (a1), wherein the biomass-derived polycarbonate polyol (a1) is produced using biomass-derived decanediol as a raw material, a polyisocyanate (b), and an alkanolamine (c), the skin layer (iii) is formed from a urethane resin composition, the urethane resin composition including an anionic urethane resin(S) and water (T), and the anionic urethane resin(S) is produced using, as raw materials, a polycarbonate polyol (A-1) produced using butanediol and biomass-derived decanediol as a raw material, and a polycarbonate polyol (A-2) produced using butanediol and a biomass-derived dihydroxy compound having a cyclic ether structure as a raw material, and wherein, a mass ratio of polycarbonate polyol (A-1) and polycarbonate polyol (A-2) is in the range of 98/2 to 90/10.

2. The synthetic leather according to claim 1, wherein a molar ratio [(C4)/(C10)] of the butanediol (C4) to the biomass-derived decanediol (C10) in the polycarbonate polyol (A-1) is within a range of 50/50 to 98/2.

3. The synthetic leather according to claim 2, wherein the polycarbonate polyol (A-2) is produced further using hexanediol as raw materials.

4. The synthetic leather according to claim 2, wherein the biomass-derived dihydroxy compound having the cyclic ether structure is biomass-derived isosorbide.

5. The synthetic leather according to claim 1, wherein the polycarbonate polyol (A-2) is produced further using hexanediol as raw materials.

6. The synthetic leather according to claim 5, wherein a molar ratio [(C4+C6)/(ISB)] of a total of the butanediol (C4) and the hexanediol (C6) to the biomass-derived dihydroxy compound (ISB) having the cyclic ether structure in the polycarbonate polyol (A-2) is within a range of 30/70 to 90/10.

7. The synthetic leather according to claim 6, wherein the biomass-derived dihydroxy compound having the cyclic ether structure is biomass-derived isosorbide.

8. The synthetic leather according to claim 5, wherein the biomass-derived dihydroxy compound having the cyclic ether structure is biomass-derived isosorbide.

9. The synthetic leather according to claim 1, wherein the biomass-derived dihydroxy compound having the cyclic ether structure is biomass-derived isosorbide.

* * * * *